US005983771A

United States Patent [19]

Lehr

[11] Patent Number: 5,983,771

[45] Date of Patent: Nov. 16, 1999

[54] INTERFACE FOR DIGITAL DATA TRANSFER BETWEEN A MISSILE AND A LAUNCHER

[75] Inventor: Hubert Lehr, Radolfzell, Germany

[73] Assignee: Bodenseewerk Geratetechnik GmbH, Uberlingen, Germany

[21] Appl. No.: 08/854,068

[22] Filed: May 8, 1997

[30] Foreign Application Priority Data

May 9, 1996 [DE] Germany ..... 196 18 602

[51] Int. Cl.[6] ..... F42C 17/00; B64D 1/04

[52] U.S. Cl. ..... 89/6.5; 89/1.55

[58] Field of Search ..... 244/175, 63, 3.11, 244/3.16; 102/206, 201, 266; 89/1.55, 6, 6.5

[56] References Cited

U.S. PATENT DOCUMENTS

| | | | |
|---|---|---|---|
| 3,228,337 | 1/1966 | Grantham et al. | 102/201 X |
| 3,306,206 | 2/1967 | Grantham | 102/206 |
| 4,091,734 | 5/1978 | Redmond et al. | 89/6.5 X |
| 4,322,998 | 4/1982 | Fowler et al. | 89/1.55 |
| 4,597,345 | 7/1986 | Reeser et al. . | |
| 4,632,031 | 12/1986 | Jarrott et al. | 102/206 X |
| 4,825,151 | 4/1989 | Aspelin | 89/1.56 |
| 4,936,187 | 6/1990 | Teeter | 89/1.55 |
| 4,979,424 | 12/1990 | Becker et al. | 89/6.5 |
| 4,985,922 | 1/1991 | Kolbert | 380/59 |
| 5,614,896 | 3/1997 | Monk et al. | 340/945 |

FOREIGN PATENT DOCUMENTS

| | | |
|---|---|---|
| 0 650 027 A2 | 4/1995 | European Pat. Off. . |
| 2 687 260 A1 | 8/1993 | France . |
| 30 33 357 A1 | 4/1982 | Germany . |
| 3033357 C2 | 4/1982 | Germany . |
| 31 27 379 A1 | 1/1983 | Germany . |
| 3127379 A1 | 1/1983 | Germany . |
| 3640099 C2 | 6/1988 | Germany . |
| 3809972 A1 | 10/1989 | Germany . |

OTHER PUBLICATIONS

Lemme in "Elektronik" Mar. 1995, pp. 68–71.

*Primary Examiner*—Charles T. Jordan
*Assistant Examiner*—Theresa M. Wesson
*Attorney, Agent, or Firm*—McDermott, Will & Emery

[57] ABSTRACT

Contactless data transfer devices are provided as an interface for the digital data transfer between a missile and a launcher in which the missile is accomodated.

7 Claims, 2 Drawing Sheets

INTERFACE FOR DIGITAL DATA TRANSFER BETWEEN A MISSILE AND A LAUNCHER

TECHNICAL FIELD

The invention relates to an interface for the digital data transfer between a missile and a launcher, in which the missile is accomodated.

BACKGROUND ART

Missiles are accomodated in launchers at the wings of airplanes. From these launchers they are fired by igniting the engine. Before firing the missile is connected with the airplane by one or more umbilicals. These umbilicals are released during or before the firing. The supply of the missile with electricity and cooling gas takes place via such umbilicals prior to the firing, so that the supply of electricity and cooling gas by aggregates belonging to the missile has only to take place during the flight after firing. The cooling gas is directed to a Joule-Thomson-cooler to cool a detector in the seeker head of a target-tracking missile. There is also an exchange of data available in digital form between the airplane and the missile. This exchange of data is performed through a plug. This plug is unplugged from the missile by a pull-back-mechanism shortly before the firing and pulled back into the launcher. The connections have to be made manually during the loading of the launcher with the missile. This is a source of errors. Furthermore the pulling back of the plug by a mechanical pull-back-mechanism requires time. Therefore a delay between the firing command and the actual firing has to be provided.

DISCLOSURE OF THE INVENTION

It is an object of the invention, to simplify the interface for the digital data transfer between the missile and the airplane, to make the loading of the launcher with the missile easier and more secure and to avoid delays at the firing of the missile.

According to the invention this object is achieved in that contactless data transfer devices are provided as an interface at the missile and the launcher.

In such way the data interface does not comprise mechanical connections. The coupling is achieved automatically, when the missile is accomodated in its correct position in the launcher. During the loading process no plug-connection has to be made. The connection is also released automatically and without the necessity of a delay, when the missile is fired and leaves the launcher.

An embodiment of the invention will now be described in greater detail with reference to the accompanying drawings.

DESCRIPTION OF PREFERRED EMBODIMENT

Figure 1:
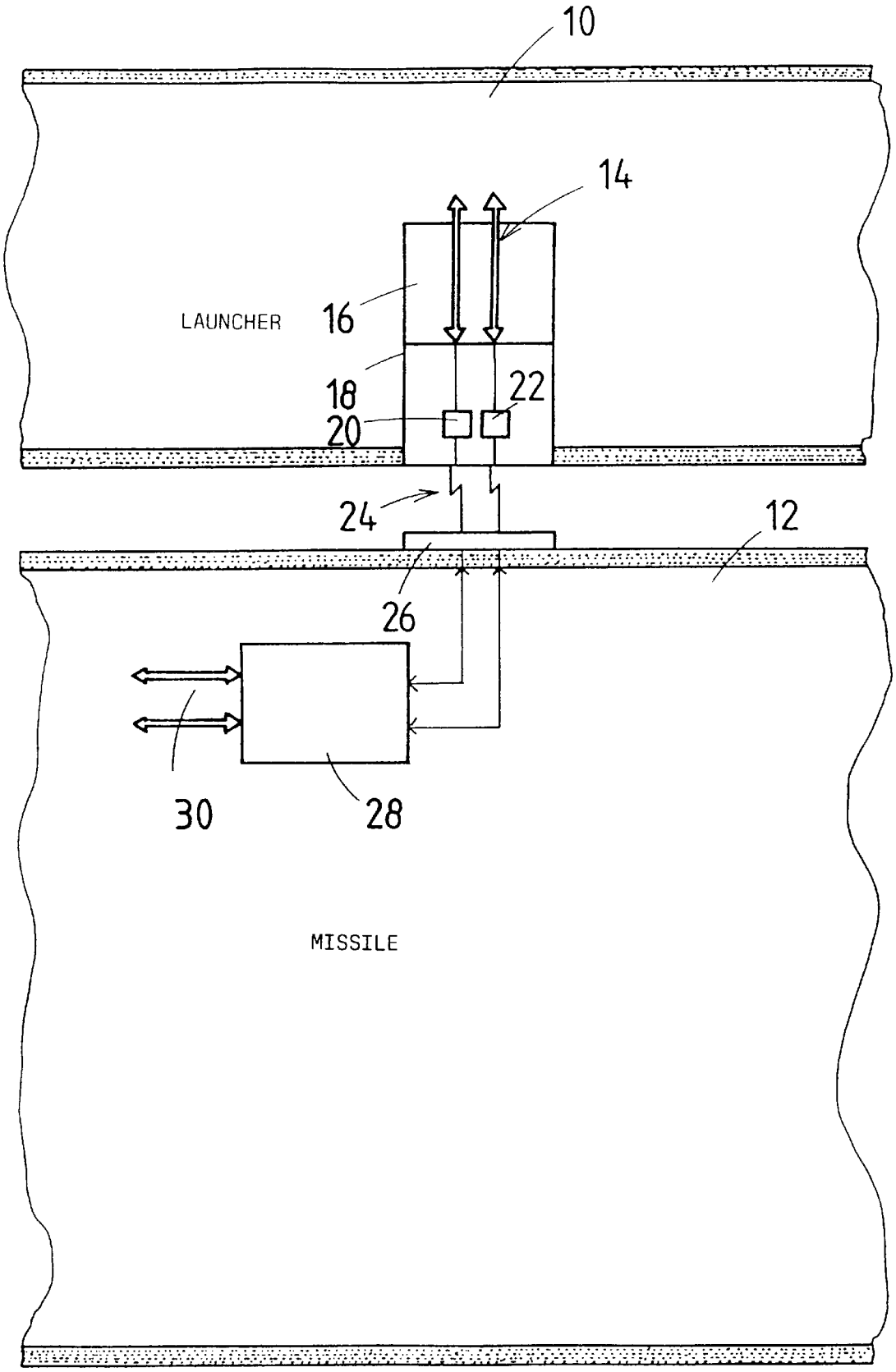
FIG. 1 is a schematic view of the launcher and the missile with a contactless interface for the transfer of digital data.

Referring to FIG. 1, numeral 10 designates a launcher. A missile 12 is accomodated in the launcher 10. In the launcher 10 a databus 14 is lead to a plug portion 16. The databus carries data in a specific format, for example MIL STD 1553

B. A Data transfer module 18 for the contactless transfer of digital data is mounted on the plug portion 16. The data transfer module operates with infrared radiation and contains a suitable transmitter and receiver, as shown in FIG. 1 by blocks 20 and 22.

The transmitter and receiver of the data transfer module 18 are connected via IR-beams 24 with receivers or transmitters, respectively, of transmitter chips and receiver chips 26 at the missile 12. The signals of the transmitter chip and receiver chip 26 are, on the missile side, converted by a converter 28 back into the format of the databus 14 and applied to a databus 30 of the missile 12.

Figure 2:
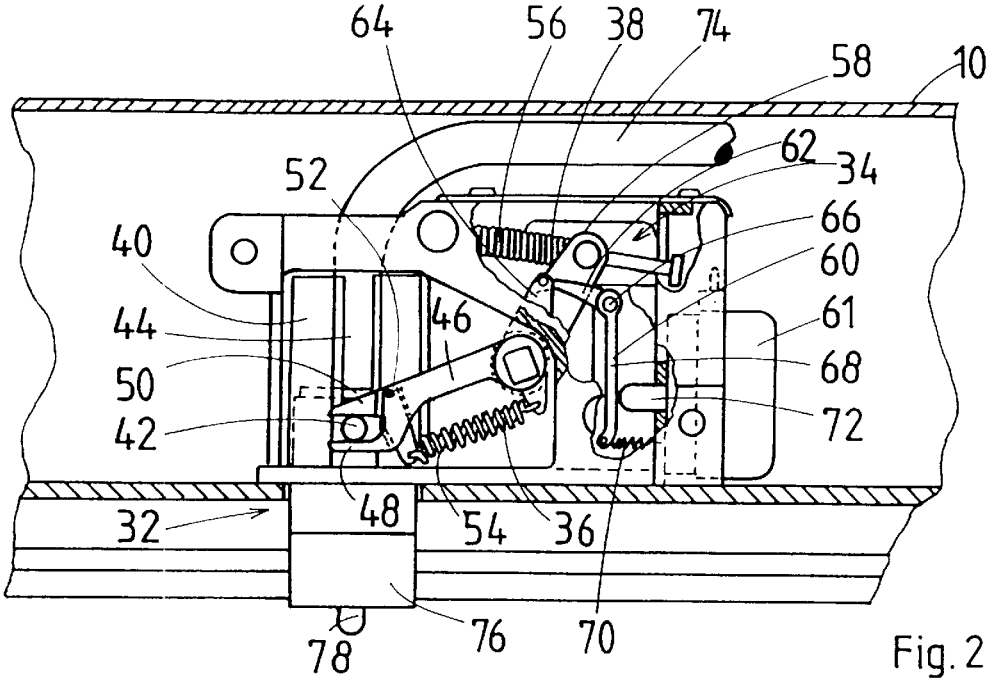
Fig. 2 PRIOR ART
FIG. 2 shows a prior art retractable plug in an interface for the transfer of digital data between an airplane and a missile.

FIG. 2 shows an interface in a prior art launcher. The interface is shown in operating position, i.e. in a position, in which the connection with the missile is active. There the plug 32 for the transfer of digital data is mounted on a pull-back mechanism 34. The pull-back mechanism 34 has an angle lever 38 with a shaft 36, pivotally mounted in bearings of. The plug 32 is guided in a guiding bracket 40 and has a pin 42, which projects through a longitudinal slot 44 of the guiding bracket 40. Fork-shaped ends of one arm 46 of the angle lever 38 extend around the projecting pin 42. The fork-shaped ends have two yaws 48 and 50. Herein the yaw 50 is formed by an angle lever, which is pivoted on the yaw 48 through a pivot bearing 52. A tension spring 54 engages at the angle lever. Thereby the two yaws 48 and 50 are always held in engagement with the pin. The spring 54 biases the plug 32 in the direction of its active position and tries to pivot the angle lever 38 conter-clockwise in FIG. 2. A compression spring 56, which overcomes the tension spring engages the other arm 58 of the angle lever 38 and tries to pivot it clockwise. This is prevented in the active position of FIG. 2 by an angle lever 60, at the arm 62, a projection 64 connected with the angle lever 38 engaging the arm 62. Thereby the angle lever 38 is retained against the action of the compression spring 56 in a position in which the plug 32 is in its active position. The angle lever 60 is pivotable around a pivot point 66. A tension spring 70 engages a second arm 68 of the angle lever 60 The tension spring tries to hold the angle lever 60 in the locked position of FIG. 2. The angle lever 60 can be pivoted clockwise by a rod 72 actuated by a solenoid 60. The arm 62 then releases the projection 64. Thereby the angle lever 38 can be pivoted clockwise by the compression spring 56. The arm 46 retracts the plug 32 through the yaw 48 and the pin 42, as in FIG. 2. This is a relatively complicated pull-back mechanism. The pulling-back requires a certain time. A delay between the switchin-on of the solenoid 61 and the actual firing of the missile has to be provided. But during this delay time the connection between the missile and the launcher 10 is already disconnected.

Figure 3:
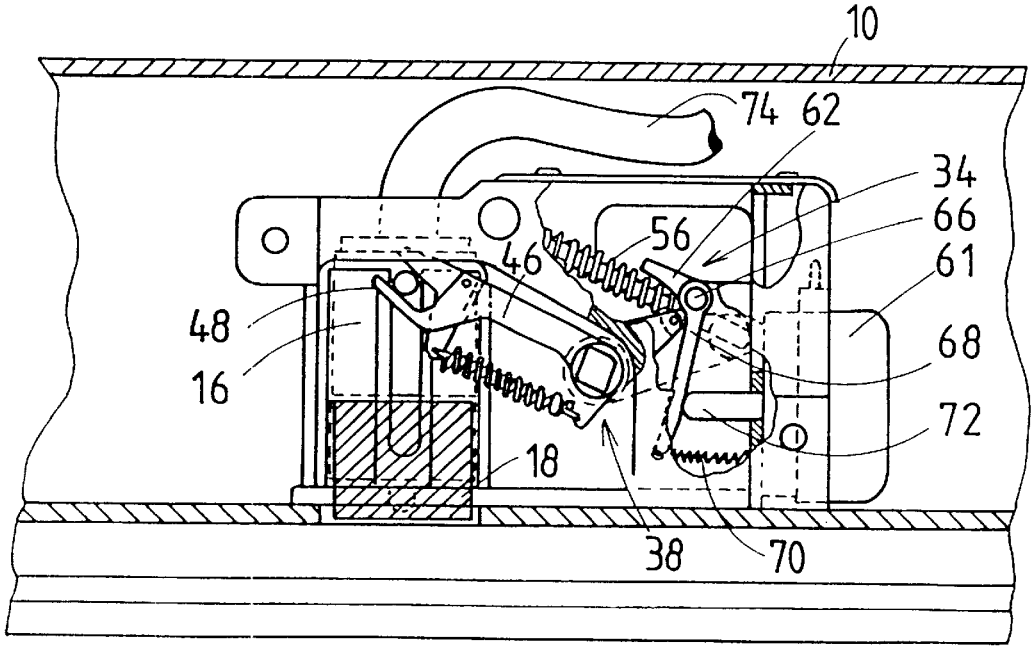
FIG. 3 shows a contactless interface obtained by modifying the launcher of FIG. 2.

There are many launchers operating, which are designed this way. It is possible to modify these existing launchers for contactless transfer of digital data. This is shown in FIG. 3.

The plug 32 (FIG. 2) comprises a plug portion 16, which is connected with the data bus of the airplane via a cable 74. Furthermore the plug 32 in FIG. 2 comprises a plug portion 76 containing the plug pins, which, when in active position, engage the socket of the missile 12. A projecting guide pin 78 ensures the correct engagement of the plug pins in the sockets.

With the modification, the data transfer module 18 is mounted on the plug portion 16 instead of the plug portion 76. The solenoid 61 is switched off. The pull-back mechanism 34 is in its retracted position, as shown in FIG. 3. The data transfer module 18 is flush with the missile-side wall of the launcher 10. The firing of the missile is not affected in this position. The space available for the data transfer module comprises not only the space, taken by the plug portion 76 but also the area, in which the guide pins 78 project.

Such a modification does not require further changes of the launcher. Therefore existing launchers operating with a plug connection as an interface can be modified with little expenditure for use with missiles, where a contactless transfer of digital data is achieved by infrared-coupling. In the modified state the solenoid 61 remains without current.

I claim:

1. A method of retrofitting a data transfer device comprising a plug, a socket for engaging with the plug and a plug pull-back mechanism, the plug pull-back mechanism comprising a plug guiding structure for rectilinearly guiding the plug from an engaged position where the plug is engaged with the socket to a disengaged position where the plug is not engaged with the socket, a spring mechanism for urging the plug from the engaged position to the disengaged position, a retainer for holding the spring mechanism to retain the plug in the engaged position and a solenoid for engaging the retainer to release the spring mechanism to move the plug to the disengaged position, said method comprising:

moving the plug to the disengaged position;

removing the plug from the guiding structure;

mounting a first contactless data transmitter/receiver in the guiding structure;

replacing the socket with a second contactless data transmitter/receiver; and switching off the solenoid.

2. A contactless data transfer device for transferring data between a missile and a launcher in which the missile is accommodated, the data transfer device comprising:

a first data transmitter/receiver in the launcher; and a second data transmitter/receiver in the missile;

wherein the first data transmitter/receiver is adapted to be mounted in a plug guiding structure of a plug pull-back mechanism of the launcher, said plug guiding structure being for rectilinearly guiding a plug from a position engaged with a socket in the missile to a position of disengagement from the socket.

3. The contactless data transfer device as claimed in claim 2, wherein the first data transmitter/receiver is shaped to be substantially flush with an outer surface of the launcher when the plug guiding structure is in the disengaged position.

4. The contactless data transfer device as claimed in claim 2, wherein the plug guiding structure comprises a sliding member for mounting the plug, and the first data transmitter/receiver is adapted to be mounted on the sliding member.

5. The contactless data transfer device as claimed in claim 2, wherein the first and second data transmitter/receivers each comprise an optical data transmitter and receiver.

6. The contactless data transfer device as claimed in claim 5, wherein the second data transmitter/receiver comprises a transmitting and receiving chip adapted to be aligned with the first data transmitter/receiver.

7. The contactless data transfer device as claimed in claim 5, wherein the first and second data transmitter/receivers transmit and receive infrared radiation.

* * * * *